US005105982A

United States Patent [19]

Takahashi et al.

[11] Patent Number: 5,105,982

[45] Date of Patent: Apr. 21, 1992

[54] BEVERAGE MIXING AND DISPENSING UNIT

[75] Inventors: Yutaka Takahashi, Fujisawa; Ikuo Harashima, Maebashi; Shunichi Nakayama, Takasaki; Yasuyuki Arai, Isesaki; Yasushi Takayanagi, Akabori; Ryoichi Sekiguchi, Isesaki; Tomomitsu Abe, Hadano; Hiroshi Hayakawa, Yokohama, all of Japan

[73] Assignees: Sanden Corporation; Kirin Brewery Co., Ltd., both of Japan

[21] Appl. No.: 332,982

[22] Filed: Apr. 4, 1989

[30] Foreign Application Priority Data

Apr. 5, 1988 [JP] Japan ..... 63-82148
Apr. 5, 1988 [JP] Japan ..... 63-82149

[51] Int. Cl.[5] ..... B67D 5/56

[52] U.S. Cl. ..... 222/82; 222/91; 222/129.1; 222/145; 222/394; 222/400.7; 222/506

[58] Field of Search ..... 222/400.7, 399, 81, 222/82, 83.5, 88-91, 481, 483, 484, 488, 511, 129.1, 129.2, 129.3, 129.4, 400.8, 185, 506, 145, 394

[56] References Cited

U.S. PATENT DOCUMENTS

| | | | |
|---|---|---|---|
| 2,189,643 | 2/1940 | Ward | 222/400.7 X |
| 2,462,019 | 2/1949 | Bowman | 222/1 |
| 2,712,887 | 7/1955 | King | 222/2 X |
| 3,065,883 | 11/1962 | Nelson | 222/399 X |
| 3,186,599 | 6/1965 | Levinson et al. | 222/400.7 X |
| 3,200,994 | 8/1965 | Levinson et al. | 222/400.7 X |
| 3,215,312 | 11/1965 | Guzzi | 222/129.1 |
| 3,231,140 | 1/1966 | Krup | 222/129.2 |
| 3,240,395 | 3/1966 | Carver | 222/129.1 |
| 3,348,737 | 10/1967 | Yingst et al. | 222/129.1 X |
| 3,638,392 | 2/1972 | Welker, Jr. et al. . | |
| 3,800,826 | 4/1974 | McCann | 222/129.1 X |
| 4,426,019 | 1/1984 | Sedam | 222/481 X |
| 4,493,441 | 1/1985 | Sedam et al. | 222/129.1 |
| 4,555,371 | 11/1985 | Jeans | 222/129.1 X |
| 4,582,223 | 4/1986 | Kobe | 222/91 |
| 4,592,490 | 6/1986 | McMichael | 222/129.1 |
| 4,649,809 | 3/1987 | Kanezashi | 222/129.4 X |
| 4,688,701 | 8/1987 | Sedam | 222/129.1 |
| 4,804,112 | 2/1989 | Jeans | 222/129.1 |
| 4,836,414 | 6/1989 | Credle, Jr. et al. | 222/400.7 X |
| 4,932,561 | 6/1990 | Boxall | 222/129.1 |
| 4,993,601 | 2/1991 | Nakayama et al. | 222/129.1 X |
| 5,033,648 | 7/1991 | Nakayama et al. | 222/129.1 |

FOREIGN PATENT DOCUMENTS 976329 11/1964 United Kingdom ..... 222/400.7

OTHER PUBLICATIONS

European Patent Application 0 102 527.

*Primary Examiner*—Kevin P. Shaver
*Attorney, Agent, or Firm*—Banner, Birch, McKie & Beckett

[57] ABSTRACT

A dispensing unit for mixing and dispensing a beverage which consists of several constituents, including syrup. The unit dispenses beverage from a bottle having a bottom outlet portion and through a syrup path controlled by a manually operable valve. A gas path in the dispensing unit supplies gas into the bottle for urging the syrup from the bottle and into the syrup path. An additional liquid is permitted to flow to a mixing chamber along with the syrup where they are mixed.

15 Claims, 7 Drawing Sheets

BEVERAGE MIXING AND DISPENSING UNIT

BACKGROUND OF THE INVENTION

This invention relates to a dispensing unit for dispensing a beverage, such as a syrup or the like, and in particular, to supplying of the beverage from a storing unit towards a controlling unit.

Various dispensing units of the above type are already known. For example, a dispensing unit which is used as a post-mixed beverage dispenser, is disclosed in U.S. Pat. Nos. 4,493,441 and 4,688,701 issued to Jason K. Sedam et al and assigned to The Coca-Cola Company. The dispensing unit, which dispenses a beverage stored in a bottle, comprises a body, a controlling unit, and a receiving unit.

The bottle has an outlet portion formed by an opening at the bottom thereof for discharging the beverage. The body of the dispension unit defines a beverage path which conducts the beverage. The receiving unit is for receiving the outlet portion of the bottle thereon so that the beverage path communicates with the bottle through the opening of the outlet portion thereof Therefore, the beverage can be discharged from the bottle through the opening of the outlet portion thereof to the beverage path. The controlling unit is coupled to the beverage path to control dispensation of the beverage.

It is advantageous that the beverage dispenser can be placed in a limited space because an external form of the beverage dispenser may be compact. However, it is difficult to always dispense the beverage at a constant dispensing rate each time the controlling unit of the beverage dispenser is operated by a user. In other words, the beverage has a flow rate which is variable dependent on the an amount of the beverage remaining in the bottle. This is because discharging of the beverage is only carried out by the gravity of the beverage in the bottle.

SUMMARY OF THE INVENTION

According to this invention, there is a dispensing unit for mixing and dispensing of a beverage which consists of several constituents including syrup, the syrup being stored in a bottle having an outlet portion defining an opening. The dispensing unit includes elements for defining a syrup path through which the syrup is dispensed and for defining a supply path through which a further fluid to be mixed with the syrup flows. The dispensing unit also includes elements for coupling the outlet portion of the bottle to the syrup path and elements for controlling dispension of the syrup through the syrup path and dispension of the further fluid through the supply path. A mixing chamber is coupled to both the syrup path and the supply path. A mixing element is disposed in the mixing chamber for mixing the syrup and the further fluid. The mixing element includes an axial central channel disposed in fluid communication with the syrup path, a plurality of radial holes open at one end to the channel and at the other end to the mixing chamber, and a plate having a plurality of grooves disposed along an outer edge.

The present invention provides a thoroughly mixed beverage from two or more different constituents.

DESCRIPTION OF THE PREFERRED EMBODIMENTS

Figure 1:
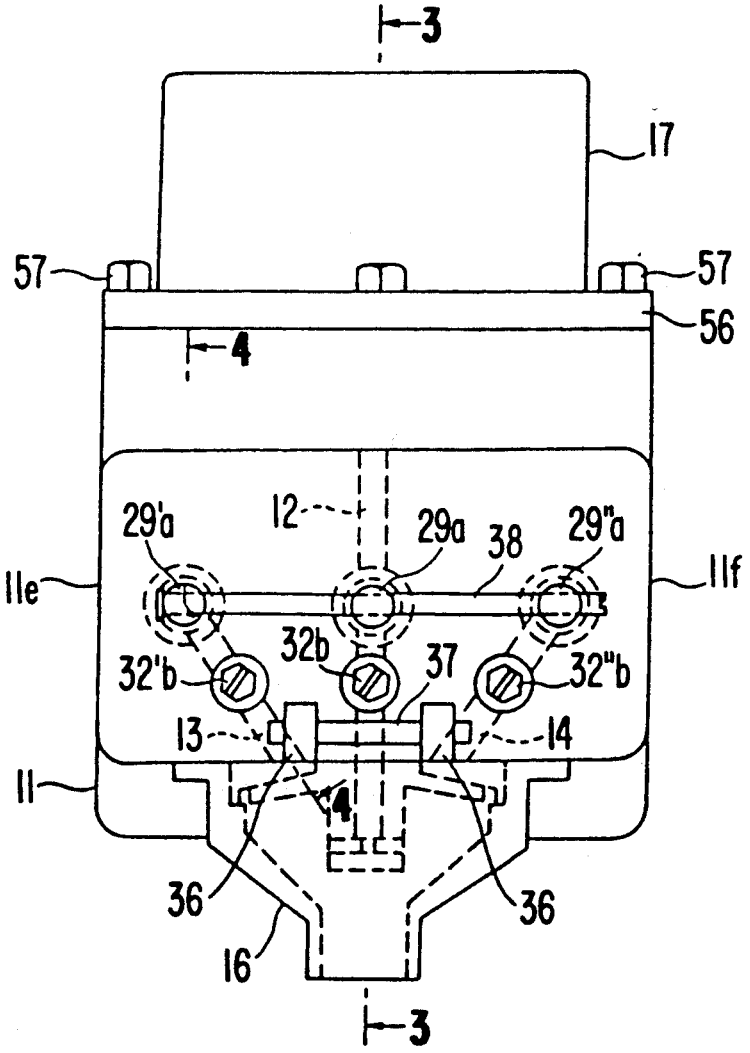
FIG. 1 is a front view of a dispensing unit according to an embodiment of this invention.

Referring to FIGS. 1 through 4, a dispensing unit according to an embodiment of the present invention is used for dispensing a beverage. The dispensing unit comprises a body 11 defined by front, rear, upper, bottom, left side, and right side surfaces 11*a*, 11*b*, 11*c*, 11*d*, 11*e*, and 11*f*. The body 11 defines syrup path 12, dilution water path 12, carbonated water path 14. Body 11 is fixed to a frame 15 by screws or the like.

The syrup path 12 extends substantially in a vertical direction along a central portion of the body 11 and has an inlet and an outlet opening which open at the upper and the bottom surfaces 11*c* and 11*d*, respectively. The dilution water path 13 and the carbonated water path 14 extend along left and right sides of the syrup path 12, respectively. Each of the dilution and the carbonated water paths 13 and 14 has an inlet and an outlet opening which open at the rear and the bottom surfaces 11*b* and 11*d*. The outlet openings of each of those paths 12, 13, and 14 communicate with a discharge tube 16 which is attached to a bottom surface 11*d* of the body 11.

The body 11 is provided with a receiving member 17 for detachably receiving therein a syrup bottle S. The syrup bottle S is generally called "a syrup bottle" which stores syrup as the beverage and is changeable to a fresh one as described in detail below.

The receiving member 17 is detachably mounted on the upper surface 11*c* of the body 11 and is changed dependent on a size of the syrup bottle S. The receiving member 17 also will be described in detail below.

Figure 3:
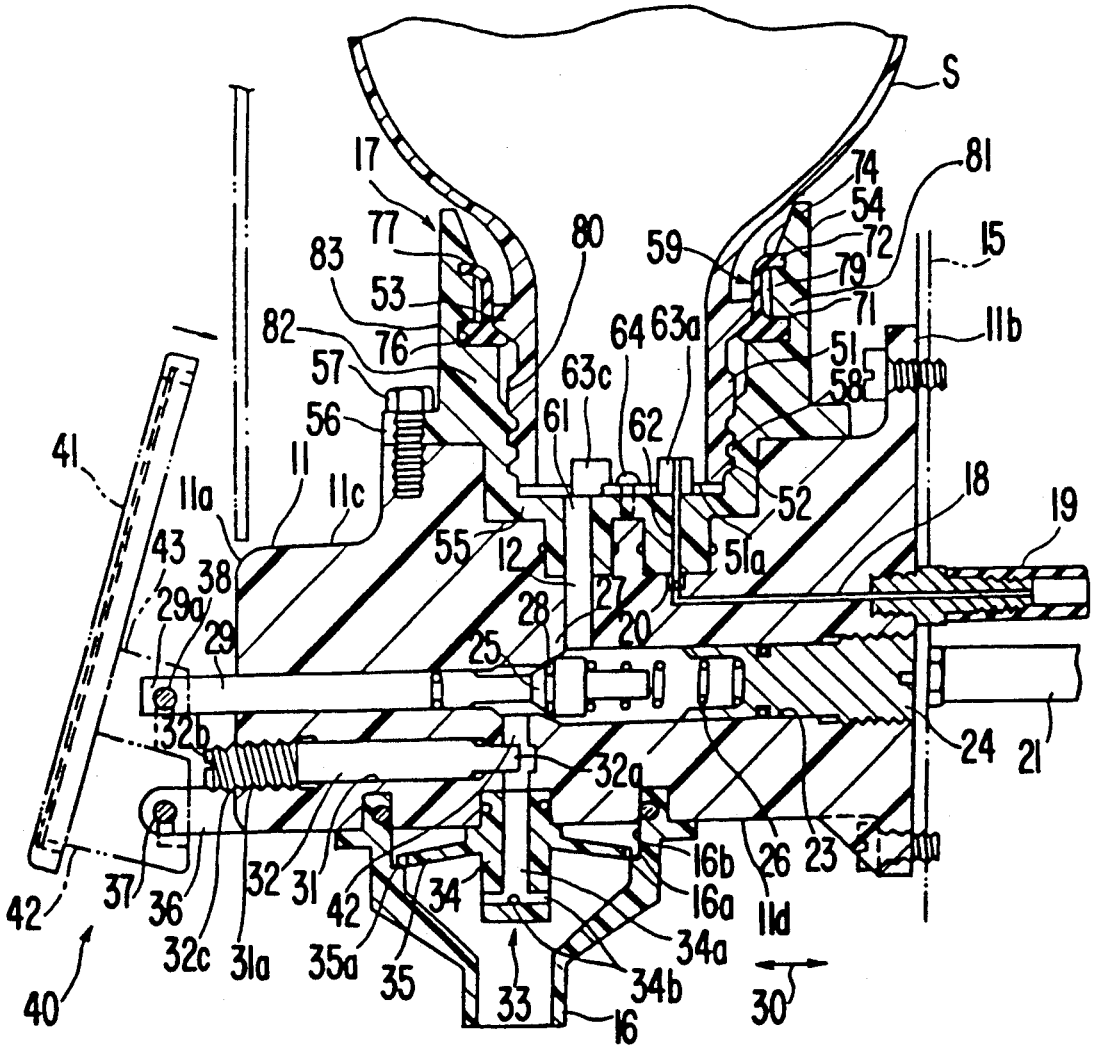
FIG. 3 is a sectional view of the dispensing unit taken along a line 3—3 in FIG. 1.

In the body 11, a gas path 18 is extends from the rear surface 11*b* to the receiving member 17 as best shown in FIG. 3. The gas path 18 is connected to a $CO_2$ gas cylinder (not shown) through a pipe 19 for supplying $CO_2$ gas from the $CO_2$ gas cylinder into the syrup tank S through a check valve 20 in order to push out the syrup therefrom into the syrup path 12. As a result, the syrup path 12 serves as a beverage path to conduct the syrup towards the discharge tube 16. The gas path 18 is referred to as a supplying device.

The dilution water path 13 is connected at the inlet opening thereof to a pipe 21 and serves to conduct dilution water from a water source (not shown) towards the discharge tube 16.

Similarly, the carbonated water path 14 is connected at the inlet opening thereof to a pipe 22 which is connected to a carbonator (not shown). The carbonated water path 14 serves to conduct carbonated water towards the discharge tube 16.

In FIG. 3, the body 11 has a cylindrical hole 23 which communicates with the syrup path 12 and which is open at the rear surface 11*b*. A closing member 24 is screwed in the cylindrical hole 23.

The dispensing unit further comprises a controlling arrangement, namely, a valve 25 placed in the cylindrical hole 23 for controlling the opening and closing of the syrup path 12. The valve 25 is forwardly urged by a spring 26 which is between the valve 25 and the closing member 24. As a result, the valve 25 is in press contact with a valve seat 27 to close the syrup path 12. In order to tightly close the syrup path 12, a seal member 28 is mounted on the valve 25.

The valve 25 is fixedly connected to a valve rod 29 which is held by the body 11 and is movable in a first predetermined horizontal direction 30. The valve rod 29 has an end 29*a* which forwardly projects from the front surface 11*a*. When the valve rod 29 is backwardly moved, the valve 25 is displaced to open the syrup path 12.

The body 11 has an adjusting hole 31 which extends from the front surface 11*a* to the syrup path 12 in the first predetermined horizontal direction 30. The adjusting hole 31 has an internal threaded portion 31*a*.

The dispensing unit further comprises an adjusting member 32 inserted into the adjusting hole 31. The adjusting member 32 has an end portion 32*a* for adjusting the flow rate of the syrup in the syrup path 12. Another end 32*b* of the adjusting member 32 forwardly protrudes from the front surface 31*a* of the body 11. The adjusting member 32 has an external threaded portion 32*c* which is screwed in the internal threaded portion 31*b*.

When the adjusting member 32 is rotated by the use of a driving member or a screw driver (not shown), it is displaced in the first predetermined horizontal direction 30. As a result, the flow rate of the syrup in the syrup path 11 can be adjusted.

Figure 4:
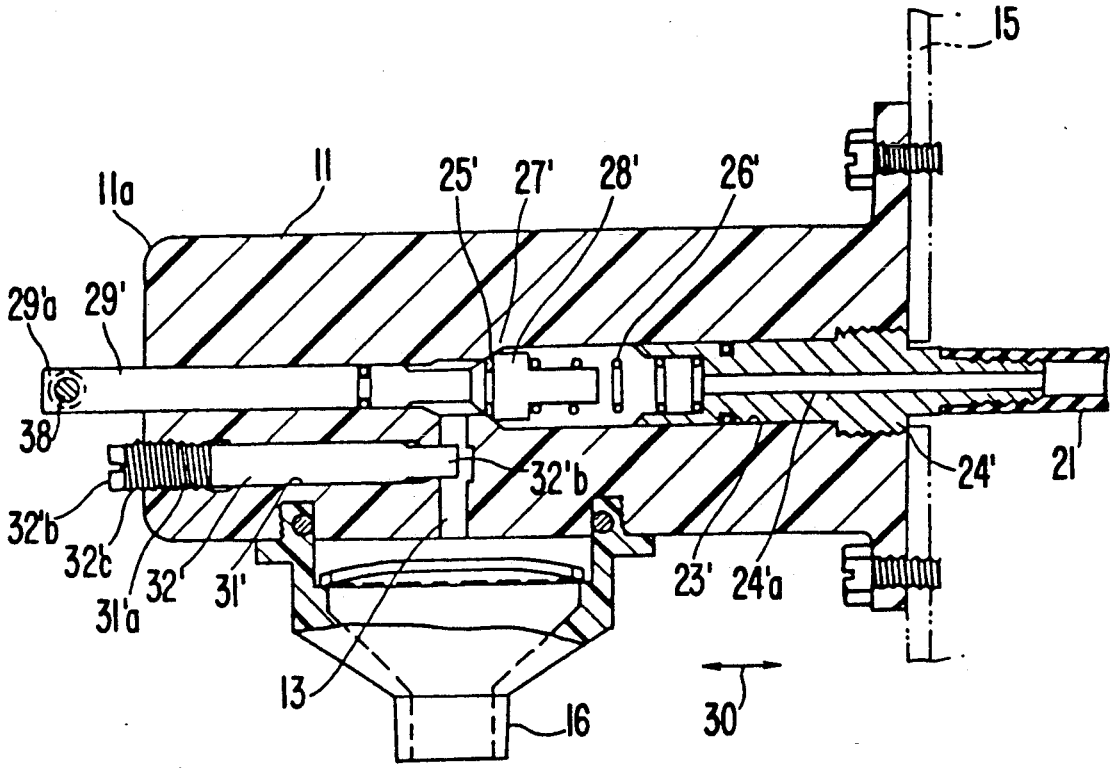
FIG. 4 is a sectional view of the dispensing unit taken along a line 4—4 in FIG. 1.

In FIG. 4, the dispensing unit is further provided with similar parts in connection with the dilution water path 13 which are designated by like reference numerals except that such reference numerals are primed. A closing member 24' has a through hole 24'*a* which serves as a part of the dilution water path 13.

When a valve rod 29' is backwardly moved, the valve 25' is displaced to open the dilution water path 13. When the adjusting member 32' is rotated, it is displaced in a first predetermined horizontal direction 30. As a result, the dilution water in the dilution water path 13 can be controlled and adjusted.

Although a detailed description has been omitted, similar construction is provided in connection with the carbonated water path 14. Therefore, similar control and adjustment are possible in connection with the carbonated water.

Mixing is carried out among the syrup, the dilution water, and the carbonated water in an interior portion of the discharge tube 16. In order to favorably carry out the mixing, the discharge tube 16 is provided with a mixing member 33 in the interior thereof.

Figure 5:
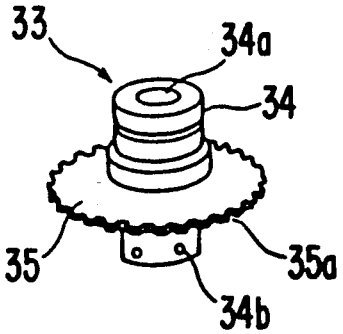
FIG. 5 is a perspective view of a mixing member included in the dispensing unit of FIGS. 1 to 4.

Referring to FIG. 5, the mixing member 33 comprises a cylindrical member 34 and a ring-shaped plate 35 fixed onto an outer peripheral surface of the cylindrical member 34. The cylindrical member 34 has a central hole 34*a* and a plurality of small side holes 34*b* extending from the outer peripheral surface of the cylindrical member 34 to the central hole 34*a*. The cylindrical member 34 is connected to the body 11 so that the central hole 34*a* communicates with the syrup path 12.

The ring-shaped plate 35 has a great number of grooves 35*a* in a peripheral surface thereof and is supported an a shoulder 16*a* formed on the inner peripheral surface of the discharge tube 16. As a result, the ring-shaped plate 35 is placed under the outlet opening of each of the dilution water path 13 and the carbonated water path 14. In addition, the peripheral surface of the ring-shaped plate 35 faces an inner peripheral surface 16*b* of the discharge tube 16 to produce a guiding small hole therebetween for the dilution water and the carbonated water.

Returning to FIGS. 1 through 4, the body 11 is provided with two arms 36 fixedly mounted on the front surface 11*a* thereof for fixedly holding a shaft 37. The shaft 37 has a pivot axis extending in a second horizontal direction which intersects the first predetermined horizontal direction 30.

The valve rods 29, 29', and 29'' are connected with one another through a pin rod 38 in front of the front surface 11*a* of the body 11.

Figure 6:
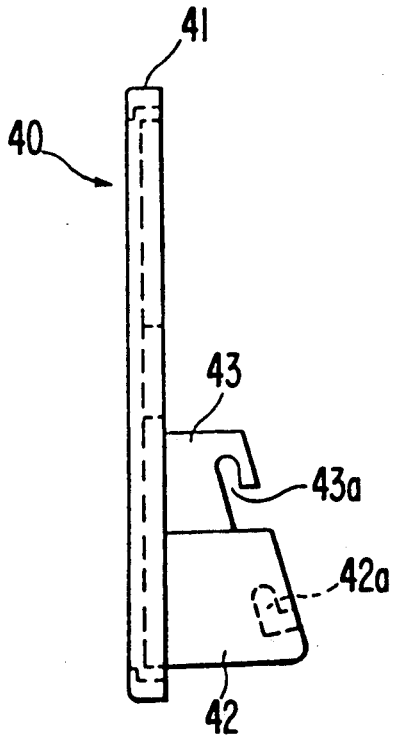
FIG. 6 is a side view of an operating member included in the dispensing unit of FIG. 3.
Figure 7:
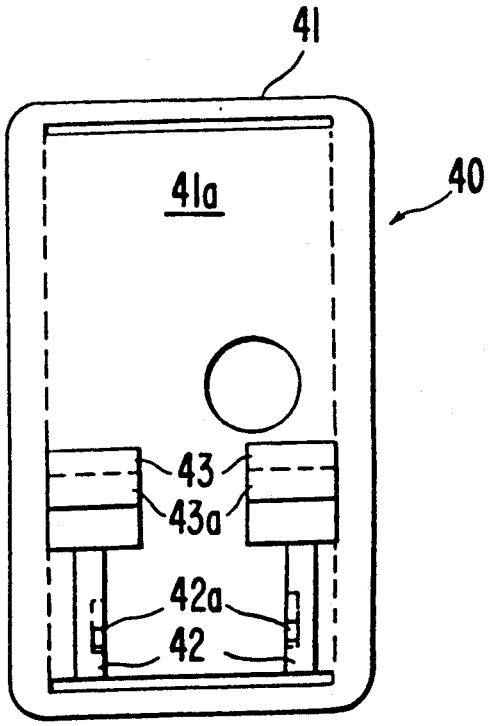
FIG. 7 is a rear view of the operating member illustrated in FIG. 6.

The dispensing unit further comprises an operating member 40 which is operated by an operator or a user. Referring to FIGS. 6 and 7, the structure shown in addition to FIG. 3, the operating member 40 comprises a plate portion 41, two attaching portions 42, and two hooking portions 43. The plate portion 41 has a back surface 41*a* generally facing front surface 11*a* of the body 11. Therefore, the end portions 32*b*, 32'*b*, and 32''*b* of the adjusting members 32, 32', and 32'' are covered with the plate portion 41.

Each of the attaching portions 42 is formed integral with the back surface 41*a* of the plate portion 41 and has an attaching groove 42*a* for receiving both ends of the shaft 37 therein. The attaching groove 42*a* is extended to permit movement of the operating member 40 in the first and the second predetermined directions.

Each of the hooking portions 43 is formed integral with the back surface 41*a* of the plate portion 41 and has a hooking groove 43*a* for receiving the pin rod 38 therein to hook the hooking portion 41 with the pin rod 38. The hooking groove 43*a* is extended so that the hooking portion is removable from the pin rod 38 with the operating member 40 moved upwardly.

When the plate portion 41 is pushed rearwardly by an operator or a user, the operating member 40 is pivotally moved around the shaft 37. Responsive to operation of the operating member 40, the valve rods 29, 29', and 29'' are moved rearwardly to open the syrup path 12, the dilution water path 13, the carbonated water path 14. As a result, the syrup, the dilution water and carbonated water are discharged in the discharge tube 16 and then mixed with one another therein to produce a mixed beverage. The mixed beverage is discharged from the discharge tube 16 into a cup.

If adjustment of the flow rate of the syrup is desired, the hooking portions 43 are removed with the operating member 40 moved upwardly. Then, an upper part of the plate portion 41 is pulled forwardly so that the operating member 40 is pivotally moved downwardly around the shaft 37. As a result, the plate portion 41 does not cover the end portion 29a of the adjusting member 29. In other words, the end portion 29a of the adjusting member 29 is exposed ahead of the body 11. Therefore, the adjusting member 29 can be readily operated to adjust the flow rate of the syrup through the syrup path 12. Similarly, adjustment of the flow rate of each of the dilution water and the carbonated water can be accomplished.

Figure 2:
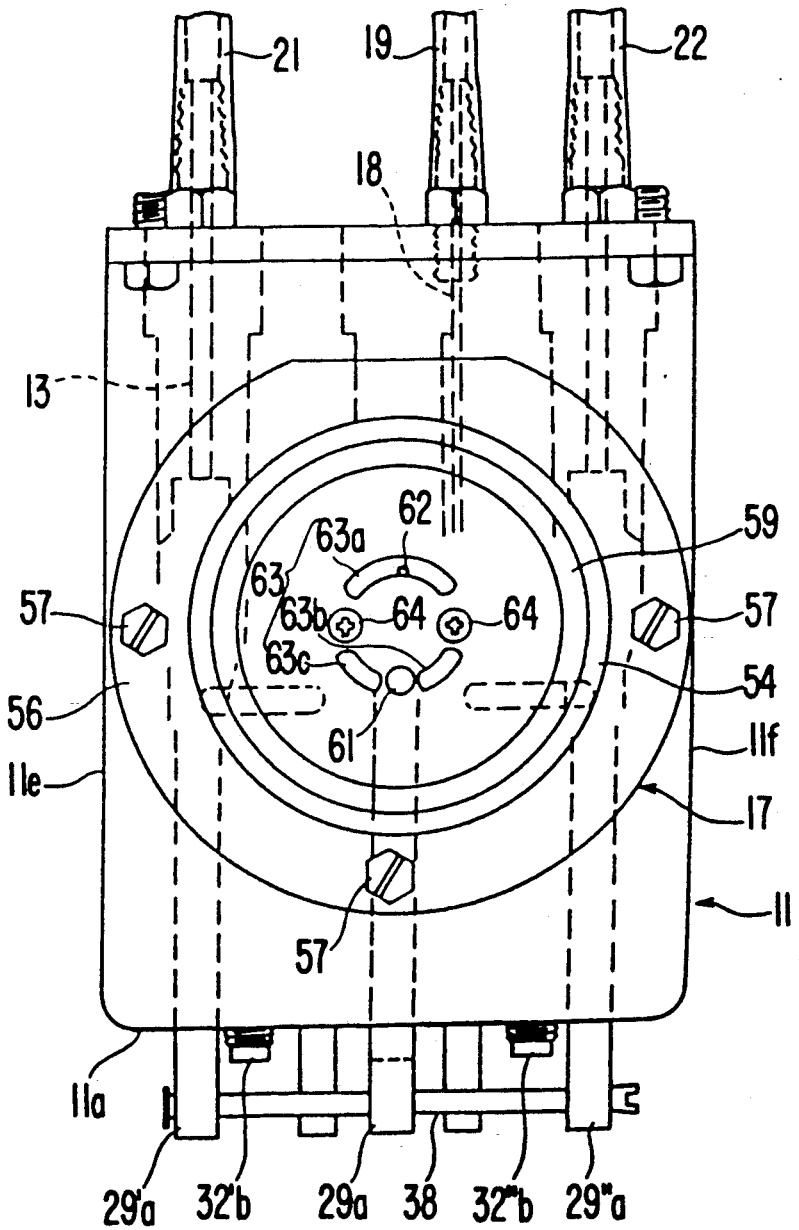
FIG. 2 is a plan view of the dispensing unit illustrated in FIG. 1.
Figure 8:
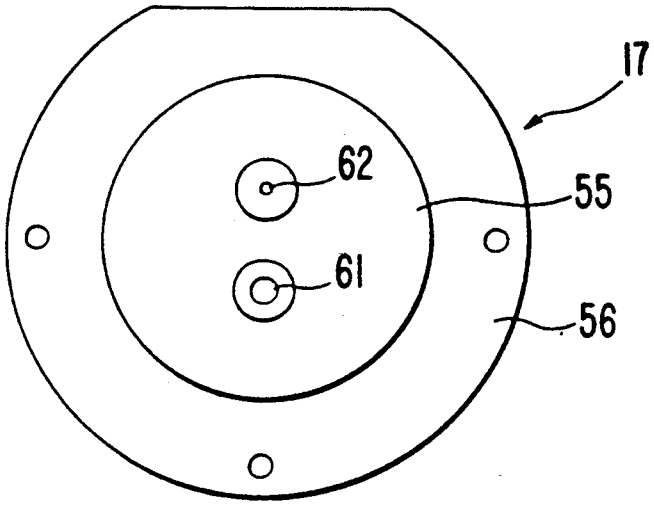
FIG. 8 is a bottom view of a receiving member included in the dispensing unit shown in FIGS. 1 through 4.

Referring to FIG. 8 in addition to the structure shown is FIGS. 2 and 3, further details of the syrup bottle S and the receiving member 17. The syrup bottle S has an outlet portion 51 which is for discharging the syrup. When the bottle S is not received in the receiving member 17, the outlet portion 51 has an opening end 51a closed by a bottle closing member (not shown). The outlet portion 51 has a thread 52 and a protruding part 53 which are formed on an outer peripheral surface 80 thereof. The protruding part 53 circularly extends along the outer peripheral surface 80 of the outlet portion 51 and protrudes outwardly a greater distance than the thread 52.

The receiving member 17 comprises a cylindrical portion 54 and a bottom portion 55 formed integral with an end of the cylindrical portion 54. The cylindrical portion 54 comprises a flange portion 56 on an outer peripheral surface 83 thereof. The flange portion 56 is fixed to the upper surface 11c of the body 11 by fixing screws 57. Therefore, it is readily possible to change the receiving member 17 by removing the screws 57.

The cylindrical portion 54 further comprises a thread 58 on an inner peripheral surface 82 thereof. The thread 58 mates with the other thread 52 of the outlet portion 51 to hold the syrup bottle S. The cylindrical portion 54 is referred to as a holding arrangement.

The cylindrical portion 54 is provided with a sealing member 59 on the inner peripheral surface 82 thereof. Seal holding element 81 comprises at least a part of cylindrical portion 54 and detachably secures the sealing member 59 to the receiving member 17. The sealing member 59 is for sealing the cylindrical portion 54 and the outlet portion 51 as described in detail below.

The bottom portion 55 has first and second through holes 61 and 62 which are connected with the syrup and the gas paths 12 and 18, respectively. The first through hole 61 is for conducting syrup from the syrup bottle S to the syrup path 12. The second through hole 62 is for conducting the $CO_2$ gas from the gas path 18 to the syrup bottle S.

Reviewing FIGS. 2 and 3, the bottom portion 55 of the receiving member 17 is provided with a plurality of cutting elements 63a, 63b, and 63c which are circularly arranged in the cylindrical portion 54 and which will collectively be called a knife 63. The knife 63 is placed on an upper surface of the bottom portion 55 and is fixed thereto by fixing screws 64. It is apparent that the knife 63 does not close the first and the second through holes 61 and 62.

The knife 63 is used for cutting the closing member of the outlet portion 51 of the syrup bottle S. When the thread 52 of the outlet portion 51 is screwed in the mating thread 58 of the cylindrical portion 54 with the syrup bottle S rotated, the knife 63 cuts a peripheral portion of the closing member of the outlet portion 51. Therefore, the syrup bottle S communicates with each of the first and the second through holes 61 and 62. As a result, the $CO_2$ gas flows in the syrup bottle S through the gas path 18 and the second through hole 62, so that the syrup is pushed out from the syrup bottle S to the first through hole 61.

With this structure, it is possible to dispense syrup constant at a rate without being influenced the quantity of the syrup in the bottle S each time when the operating member 40 is operated by a user.

Figure 9:
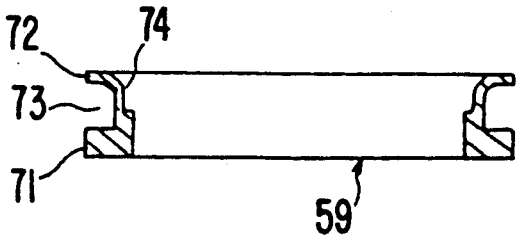
FIG. 9 is a sectional view of a sealing member included in the dispensing unit shown in FIGS. 1 through 4.

Referring to FIG. 9 in conjunction with FIG. 3, attention is directed to the sealing member 59. The sealing member 59 is of elastic material, such as rubber and the like, and is formed in a ring shape. The sealing member 59 has first and second flange parts 71 and 72 which define an outer groove 73 therebetween. A curved part 74 is formed adjacent to the second flange part 72.

The cylindrical portion 54 of the receiving member 17 has first and second grooves 76 and 77 on the inner peripheral surface 82 thereof. The sealing member 59 is attached to the cylindrical portion 54 with the first and the second flange parts 71 and 72 snugly fitted in the first and the second grooves 76 and 77, respectively. Preferably, the sealing member 59 has an inner diameter which is greater than an outer diameter of the thread 52 and less than that of the protruding part 53.

After the sealing member 59 is attached to the cylindrical portion 54, it is deformed as clearly shown in FIG. 3. As a result, a space 79 is left between the sealing member 59 and the receiving member 17 to correspond to the outer groove 73. The space 79 is for allowing a slight deflection of the sealing member 59.

When the outlet portion 51 of the syrup bottle S is inserted into the receiving member 17, the protruding part 53 is pressed into contact with the sealing member 59. Therefore, the sealing member 59 has a part which, upon being is pushed by the protruding part 53, is outwardly deformed . As a result, seal an effective occurs between the sealing member 59 and the protruding part 53. In addition, the protruding part 53 can be smoothly inserted in inside of the sealing member 59 because the sealing member 59 has the curved part 74.

Figure 10:
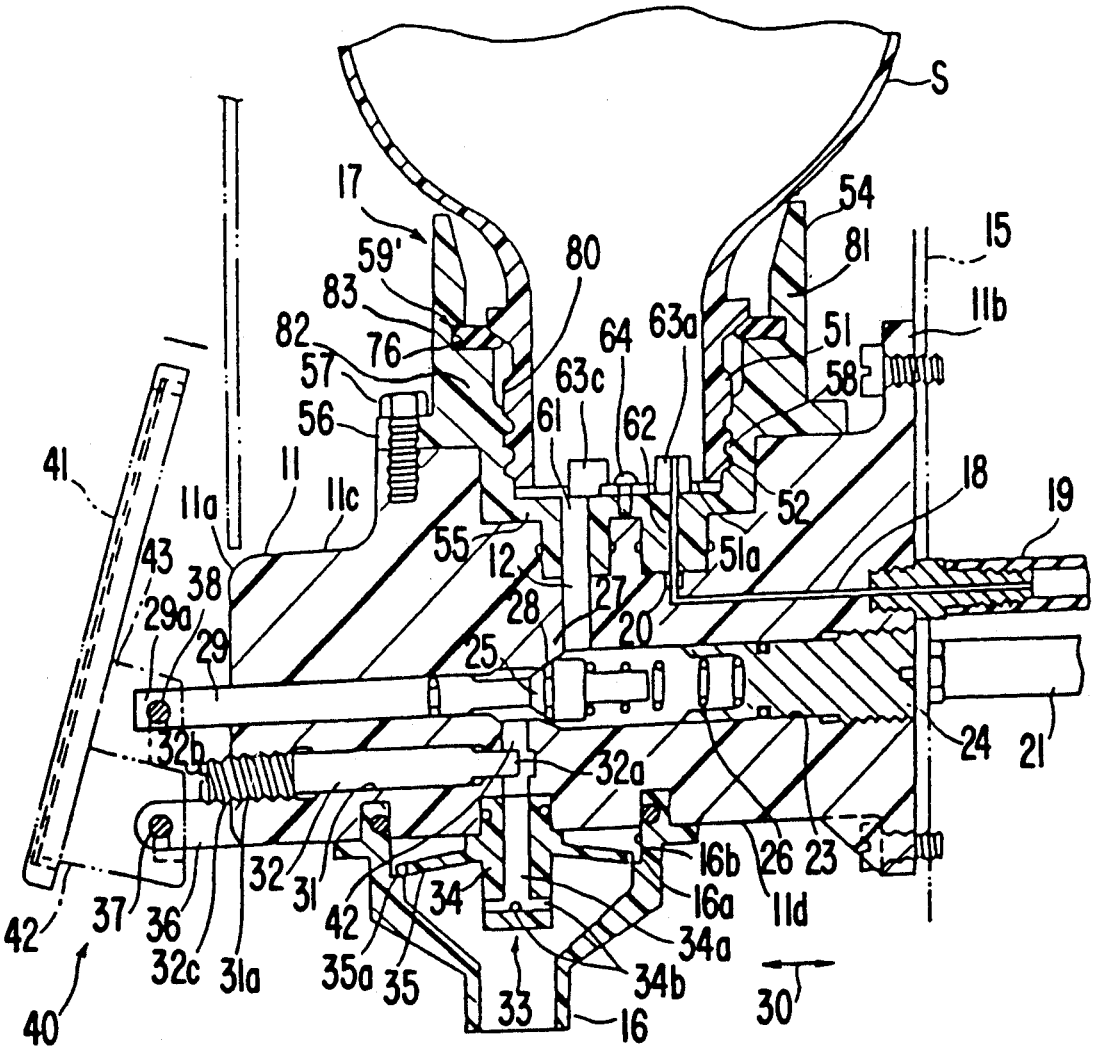
FIG. 10 is a sectional view of a dispensing unit according to another embodiment of this invention.

Referring to FIG. 10, a dispensing unit according to another embodiment is illustrated. The dispensing unit comprises similar parts designated by like reference numerals. In the dispensing unit, the cylindrical portion 54 of the receiving member 17 is provided with a modified sealing member 59' in place of the above-mentioned sealing member 59. The modified sealing member 59' has a very simple ring shape. Therefore, it is readily possible to manufacture the modified sealing member 59'

While the present invention has been described in connection with only preferable embodiments thereof, it will readily be possible for those skilled in the art to put this invention into practice in various other manners. For example, the beverage may be a special type drink, such as carbonated drinking liquid, which is different from the syrup.

What is claimed is:

1. A dispensing unit for mixing and dispensing a beverage which consists of several constituents including syrup, the syrup being stored in a bottle having an outlet portion defining an opening, said dispensing unit comprising:

dispensing means for defining a syrup path through which the syrup stored in the bottle is dispensed and a supply path through which a further fluid to be mixed with the syrup flows;

receiving means for receiving and securing the bottle, said receiving means coupling the outlet portion of the bottle to the syrup path;

control means coupled to the syrup path and the supply pat for controlling the dispensation of the syrup through the syrup path and the further fluid through the supply path;

a mixing chamber coupled to the syrup path and the supply path; and mixing means disposed in said mixing chamber for mixing the syrup and the further fluid be distributing the syrup and the further fluid throughout said mixing chamber, said mixing means including an axial central channel disposed in fluid communication with the outlet of the syrup path, a plurality of radial holes open at one end to said channel and at the other end to said mixing chamber, and a plate having a plurality of grooves disposed along an outer edge thereof, said edge of said plate being disposed adjacent an inner wall of said mixing chamber.

2. The dispensing unit according to claim 1, said further supply path having an outlet disposed above said plate.

3. The dispensing unit according to claim 1 wherein said plate is ring-shaped.

4. The dispensing unit according to claim 1 wherein said mixing means comprises a cylindrical member.

5. The dispensing unit according to claim 1, further comprising a sealing member coupled to said receiving means for liquid tightly sealing said receiving means and said outlet portion received therein.

6. The dispensing unit as claimed in claim 5, said outlet portion of the bottle having an outer peripheral surface, wherein said receiving means comprises seal holding means having an inner peripheral surface for holding said sealing member so that said sealing member protrudes inwardly from said inner peripheral surface in pressed contact with said outer peripheral surface when said outlet portion is received on said receiving means.

7. The dispensing unit according to claim 1, wherein said receiving means comprises holding means coupled to said body for detachably holding said outlet portion of the bottle.

8. The dispensing unit according to claim 7, said outlet portion of the bottle having an outer peripheral surface, wherein said holding means has a predetermined axis extending in a predetermined direction an inner peripheral surface surrounding said predetermined axis, said holding means comprising engaging means coupled to said inner peripheral surface for engaging with said outlet portion in said predetermined direction when said outlet portion is received on the receiving means.

9. The dispensing unit according to claim 8, said outlet portion of the bottle having a thread formed on said outer peripheral surface, wherein said engaging means comprises another thread formed on said inner peripheral surface of the holding means for mating with the first-mentioned thread.

10. The dispensing unit according to claim 1, further comprising fixing means for detachably fixing said receiving means on said body.

11. The dispensing unit according to claim 1, said bottle comprising a bottle closing member closing said opening of the outlet portion, wherein said receiving means comprises cutting means for cutting said bottle closing member when said bottle is received on said receiving means.

12. The dispensing unit according to claim 1 wherein said control means comprises flow valves disposed int eh syrup path and the supply path for starting or stopping dispensation of the syrup and said further fluid when said control means is actuated.

13. The dispensing unit according to claim 1 further comprising a gas supplying means coupled to said bottle for supplying gas into said bottle through said opening of the outlet portion so that said gas urges said beverage from said bottle towards said syrup path through said opening.

14. The dispensing unit according to claim 13, wherein said supplying means comprises a gas path which is connected with said receiving means.

15. The dispensing unit according to claim 14, said supplying means further comprises check valve means coupled to said gas path for checking the syrup flow from said bottle in said gas path.

* * * * *